United States Patent [19]

Yoder

[11] Patent Number: 4,867,046

[45] Date of Patent: Sep. 19, 1989

[54] VENT SYSTEM FOR STORAGE BINS

[75] Inventor: Dennis G. Yoder, Nappanee, Ind.

[73] Assignee: CTB, Inc., North Milford, Ind.

[21] Appl. No.: 213,090

[22] Filed: Jun. 29, 1988

[51] Int. Cl.[4] ..... E04H 7/00

[52] U.S. Cl. ..... 98/55; 52/82; 98/DIG. 6

[58] Field of Search ..... 52/82, 94, 95, 192; 98/54, 55, DIG. 6

[56] References Cited

U.S. PATENT DOCUMENTS

| | | | |
|---|---|---|---|
| 1,032,012 | 7/1912 | Martin | 98/55 |
| 1,191,141 | 7/1916 | Allsteadt | 98/54 X |
| 3,123,234 | 3/1964 | Bjerkan | 98/55 X |
| 3,287,886 | 11/1966 | Tiberi | 98/55 X |
| 3,583,112 | 6/1971 | Kennedy | 52/82 |
| 3,686,802 | 8/1972 | Sietmann | 98/55 X |
| 4,192,107 | 3/1980 | Wickstrom et al. | 52/82 |
| 4,480,534 | 11/1984 | Sloan | 98/55 |

*Primary Examiner*—Harold Joyce
*Attorney, Agent, or Firm*—Richard Bushnell

[57] ABSTRACT

Ventalation structure for farm storage bins and the like comprising a series of bracing members to hold a bin roof structure above a bin wall structure thereby opening the structure to uniform air circulation. Screening material is provided to prevent bugs and other objects carried by the air from entering the bin and a baffle member protect the ventalation structure from wind-blown rain and snow. The ventilation structure enables stored commodities to dry faster and minimizes the risk of dust explosions.

6 Claims, 2 Drawing Sheets

VENT SYSTEM FOR STORAGE BINS

BACKGROUND OF THE INVENTION

This invention is directed to structure for providing natural air circulation in a storage bin used for holding grain and the like. More particularly, this invention is aimed at providing vent structure which can be installed on a new, or added to an existing storage bin design to supply effective venting of the bin.

Normally, grain storage facilities are equipped with sole means of providing air circulation within the enclosure to maintain an appropriate moisture level therein and prevent a build-up of suspended dust particles likely to explode. Presently, this function is normally accomplished by providing roof vents in the form of capped or covered apertures cut into the roof of the structure. Unfortunately, roof vents of this type do not always create effective air flow within the storage enclosure and are usually hard to seal against the environment.

SUMMARY OF THE INVENTION

It is a general object of the present invention to provide venting structure for a storage bin which creates more effective, uniform air flow to prevent moisture build-up and minimize the risk of a dust explosion.

It is another general objective of the invention to provide venting structure which does not require cutting holes in a bin roof structure to install.

It is another general objective of the invention to provide venting structure which is sheltered from adverse weather conditions and does not require sealing compounds to be properly installed.

It is a more detailed object of the present invention to provide venting structure which utilizes bracket means to raise a roof structure of a storage facility from a wall structure thereof to form a sheltered air passage therebetween.

In accordance with these objectives, the structure disclosed herein comprises bracket means for uniformly raising and securing the roof structure of a new or existing grain bin design a fixed distance above a wall structure thereof. To this end, uniquely designed braces are spaced along and fastened to both the roof and wall structures, thereby dividing the distance between into segregated air vents.

To prevent debris or birds carried in the air from entering the storage bin, the air vents are covered with screening material of a suitable mesh.

Additionally, elongated panel sections are fastened to the braces to extend generally parallel with, but outward of the screening material. The panels serve to baffle air flow entering the air vents such that the air flow must come from beneath the elevation at which the air vents are located. This elongated panel arrangement further ensures against undesirable objects entering the air vents and shelters the air vents from adverse weather conditions such as rain and snow.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

DETAILED DESCRIPTION OF THE INVENTION

Figure 1:
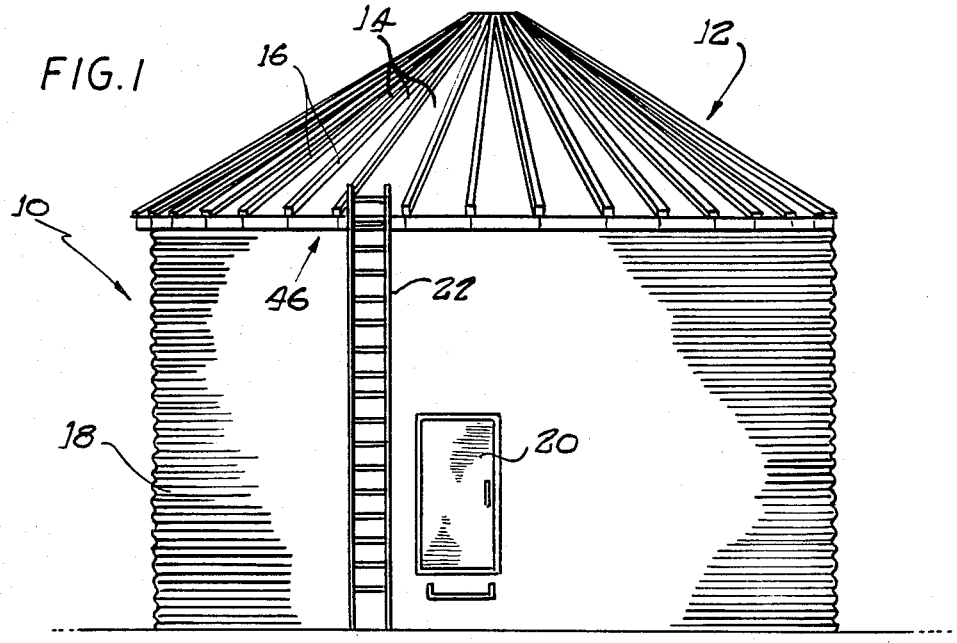
FIG. 1 is an elevational view of a typical grain bin equipped with the vent structure disclosed herein.

Turning first to FIG. 1 there is shown a conventional grain storage bin 10, which in a preferred embodiment of the invention has a conical roof structure 12 made up of triangular roof panels 14 joined together at rib junctions 16 having an inverted generally U-shaped cross section. The roof panels 14 are normally made of lightweight metal material making them durable, inexpensive and easy-to-install. Additionally, the storage bin 10 has a cylindrical wall enclosure 18 which, in the embodiment shown is formed from light corrugated metal panels and has an access door 20 and attached ladder 22.

Figure 2:
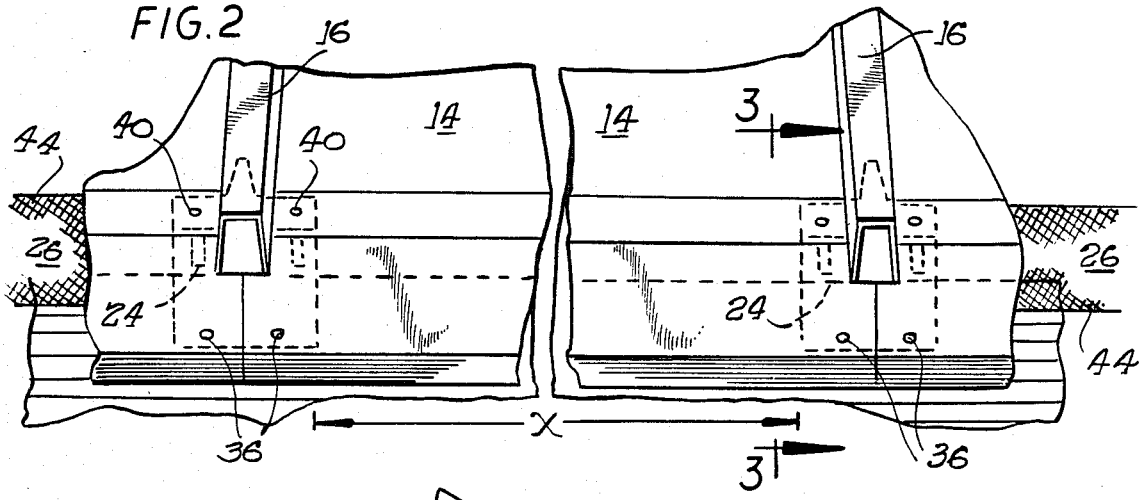
FIG. 2 is an enlarged frangmentary view showing the bracket means of the present invention properly in place.
Figure 3:
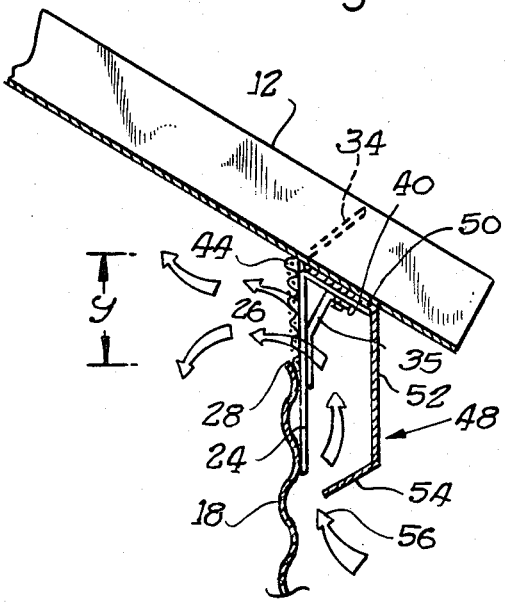
FIG. 3 is a sectional view taken along line 3—3 of FIG. 2 and includes arrows to designate the path of natural air flow through the vent structure.

In keeping with the principal objects of the present invention and as more clearly shown in FIGS. 2 and 3, the roof structure 12 is raised and held at a distance y above the wall enclosure 18 by a plurality of brackets or brace members 24 spaced therealong. As a result, a series of air vents 26, equal in number to a number of brace members 24, are opened between the roof structure 12 and an upper edge 28 of the wall enclosure 18.

Figure 4:
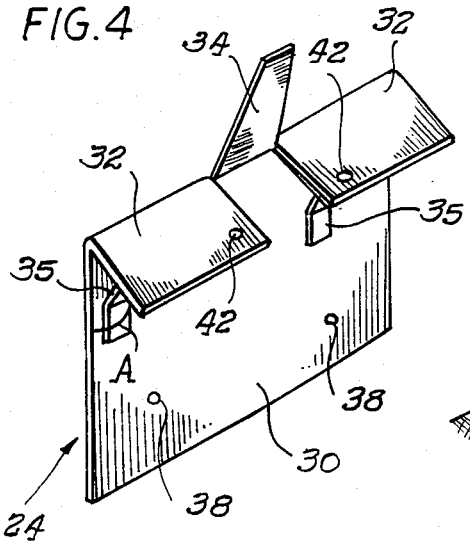
FIG. 4 is an enlarged perspective view of a brace member which forms part of the invention.

Upon inspection of FIG. 4, it will be seen that each individual brace member 24 used to elevate the roof panels 14 comprises a main body portion 30, ears 32, a tongue 34 and support bars 35. Preferably, the main body 30 is contoured to follow the arc of cylindrical wall enclosure 18 and the ears 32 are disposed at an angle A to align with roof panels 14, as more fully discussed below. Additionally, the tongue 34 projects upwardly above the ears 32.

To install the vent structure, one brace member 24 for each roof rib 16 is fastened to the cylindrical wall 18 along upper edge 28, utilizing bolts 36 and holes 38. Roof panels 14 are then placed on top of brace ears 32 such that brace tongue 34 projects up into each generally U-shaped roof rib junction 16 and substantially wedges therebetween. Once in position, the tongues 34 substantially close off the U-shaped roof rib junctions 16 and prevent access therethrough by debris, birds, snow, etc. Support bars 35 are fastened by welds for example, between ears 32 and brace body 30 to provide added support for the ears 32 under the weight of the panels 14. Fasteners 40 and apertures 42 are then used to secure the panels 14 to the braces members 24. The roof structure 12 is now locked in place above the wall enclosure 18 and several air vents 26, separated by brace members 24, exist in between.

Assuming the distance between brace members 24 is x (FIG 2), the effective vent area per roof panel 14 becomes x times y thus making the total vent area available equal to the number of brace members multiplied by the product of x and y. This total vent area far exceeds the area provided using conventional cap-type roof vents and therefore provides greater and more uniform air circulation within the bin. The increased air circulation prevents moisture build-ups and dust accummulations.

Figure 5:
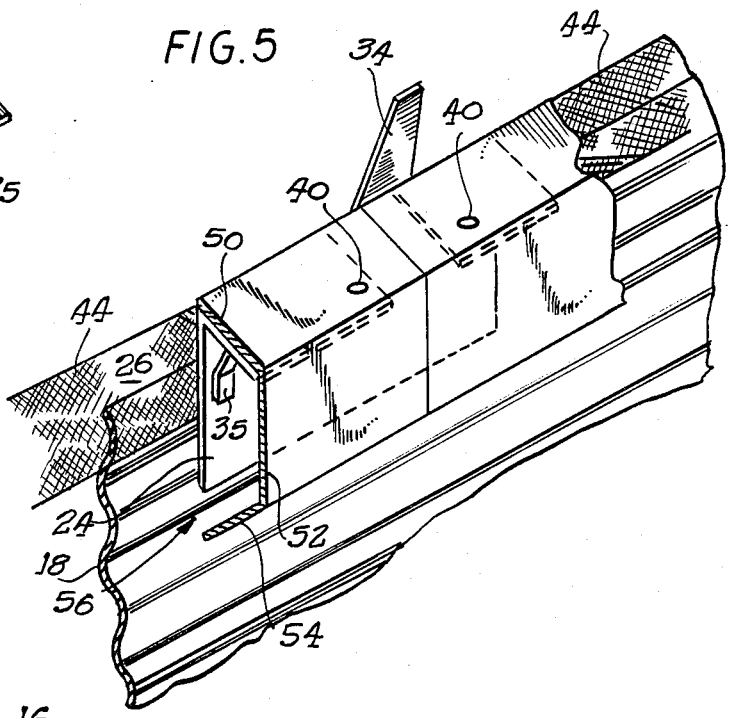
FIG. 5 is a fragmentary perspective view showing the vent structure fastened to the wall structure of a storage bin.
Figure 6:
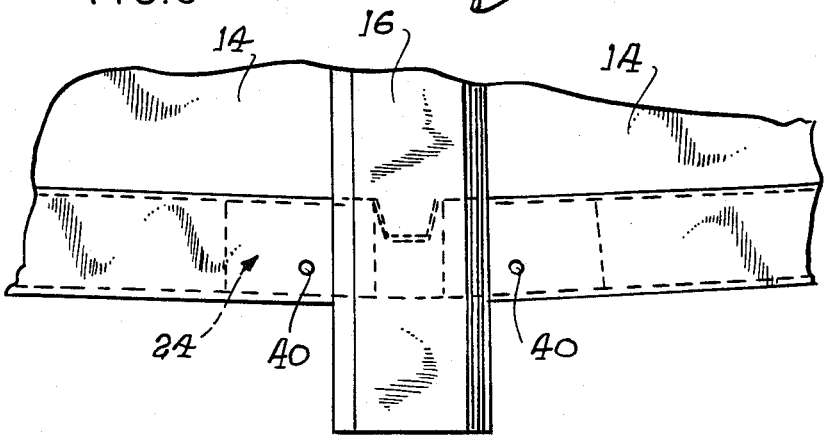
FIG. 6 is an enlarged fragmentary plan view showing a brace member properly positioned.
Figure 7:
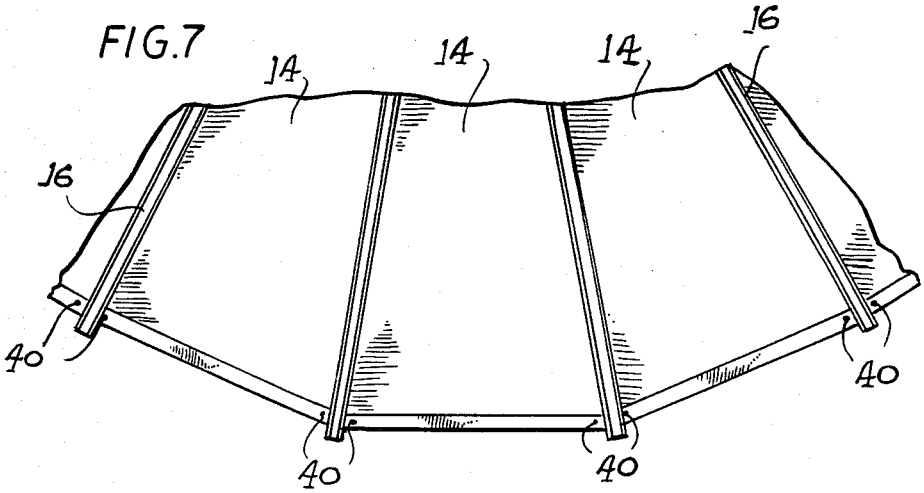
FIG. 7 is a fragmentary plan view showing several brace members fastened in place.

The present invention is also concerned with preventing debris and birds from entering the bin 10 through the vents 26. Ideally, screening 44 is therefore securely provided across each vent 26 as best shown in FIGS. 2 and 5. The screen mesh used in the screening 44 should be fine enough to prevent access by birds and the like, yet not so fine as would cause any significant reduction in air flow through the vents 26.

In order to insure against inclement weather conditions having an adverse effect on the contents of the bin 10, a unique baffle 46 is also provided. The baffle 46 consists of preferably elongate panel members 48 butted together at brace members 24. An upper leg portion 50 of the panels 48 is used to secure the panels to the braces 24 using the same holes 42 and bolts 40 used to secure the roof structure 14. The panel members 48 are open-channel in shape with a base portion 52 disposed substantially parallel with brace member body portion 30 when fixed in place. A lower leg 54 angles towards bin wall 18 from base portion 52 to further shield the passage through which natural air flow will travel to reach the air vents 26. With the baffle 46 properly in place, the lower leg or flange 54 cooperates with the bin wall 18 to define an open mouth 56 positioned well below the upper edge 28 of the wall 18 and the air vents 26. Thus, the air flow to the vents 26 must travel upward along bin wall 18, beneath the baffle 46, and through the air vent 26 as indicated by the arrows in FIG. 3. Following such a pattern, air entering the vents 24 will be free of debris and moisture even in severe weather conditions. The superior venting efficiency provided by the invention will therefore remain constant. If the storage bin 10 is provided with internal air circulation devices such as fans for example, the vent structure 26 will also serve to exhaust the fan forced air in a direction substantially opposite that indicated by the arrows in FIG. 3.

While the invention has been described in connection with a preferred embodiment, it will be understood that it is not intended to limit the invention thereto, but rather to cover all modifications and alternative constructions falling within the spirit and scope of the invention as expressed in the appended claims.

The invention is claimed as follows:

1. A ventilating structure for a storage bin used to store grain or the like, having a roof structure located on top of a wall structure, said ventilating structure comprising: bracket means for elevating and securing said roof structure at a fixed height above an upper edge of said wall structure thereby forming air vents to allow air to circulate within said storage bin, and baffle means for sheltering said air vents from inclement weather conditions, said baffle means comprising substantially C-shaped members having an intermediate portion located radially outward of and generally parallel with said air vents and a lower leg portion defining an open mouth-like air channel with said wall structure, said air channel being located below said air vent and limiting the direction from which outside air can flow into said air vents.

2. The ventilating structure of claim 1, wherein said bracket means comprise a plurality of brace members fixed in spaced relationship along the upper edge of said wall and supporting a marginal portion of said roof structure, said air vents being formed between adjacent brace members.

3. The ventilating structure of claim 1, which includes screening material fixedly attached over said air vents for restricting entry of debris and birds.

4. The ventilating structure recited in claim 1, wherein the bin roof structure comprises a plurality of panels defining a plurality of generally radially extending ribs of inverted U-shaped cross section, said bracket means including tongues projecting into said ribs thereby substantially closing off the ribs from access by birds or the like.

5. Ventilation structure for providing uniform-flow air circulation of increased capacity within a new or existing storage facility for agricultural products such as grain or the like, said ventilation structure comprising: means for elevating and holding a storage facility roof structure above a storage facility wall structure to form an extended air gap therebetween and means for preventing interference of the uniform-flow air circulation provided within the storage facility by the extended air gap caused by adverse weather conditions comprising substantially C-shaped baffle member positioned radially outward of and generally parallel with said extended air gap and having an open mouth-like air channel with said wall structure located below said extended air gap through which natural air flow entering said extended air gap must travel.

6. The ventilation structure as recited in claim 5, wherein the means for elevating and holding the roof structure above the wall structure comprise flange members spaced along and secured to both said roof structure and said wall structure, said flange members having ear-like portions for supporting said roof structure and tongue-like portions for projecting up into corresponding grooves provided in said roof structure.

* * * * *